US012098348B2

(12) United States Patent
Bouvier et al.

(10) Patent No.: US 12,098,348 B2
(45) Date of Patent: Sep. 24, 2024

(54) LUBRICANT COMPOSITION FOR OXIDATION-STABLE AUTOMOTIVE TRANSMISSION

(71) Applicant: TOTALENERGIES ONETECH, Courbevoie (FR)

(72) Inventors: Goulven Bouvier, Solaize (FR); Hakim El-Bahi, Solaize (FR); Sonia Younesse, Solaize (FR); Florence Bredon, Solaize (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 18/016,065

(22) PCT Filed: Jul. 19, 2021

(86) PCT No.: PCT/EP2021/070074
§ 371 (c)(1),
(2) Date: Jan. 13, 2023

(87) PCT Pub. No.: WO2022/018001
PCT Pub. Date: Jan. 27, 2022

(65) Prior Publication Data

US 2023/0303945 A1 Sep. 28, 2023

(30) Foreign Application Priority Data

Jul. 22, 2020 (FR) ..... 2007725

(51) Int. Cl.

| | |
|---|---|
| ***C10M 169/04*** | (2006.01) |
| ***C10M 129/76*** | (2006.01) |
| ***C10M 133/12*** | (2006.01) |
| ***C10M 133/44*** | (2006.01) |
| ***C10M 135/30*** | (2006.01) |
| ***C10M 137/10*** | (2006.01) |

(Continued)

(52) U.S. Cl.

CPC ..... *C10M 169/044* (2013.01); *C10M 129/76* (2013.01); *C10M 133/12* (2013.01); *C10M 133/44* (2013.01); *C10M 135/30* (2013.01); *C10M 137/105* (2013.01); *C10M 141/10* (2013.01); *C10M 153/04* (2013.01); *C10M 155/00* (2013.01); *C10M 157/08* (2013.01); *C10M 161/00* (2013.01); *C10M 2203/003* (2013.01); *C10M 2207/284* (2013.01); *C10M 2215/26* (2013.01); *C10M 2215/30* (2013.01); *C10M 2219/087* (2013.01); *C10M 2223/047* (2013.01); *C10M 2223/049* (2013.01); *C10M 2225/00* (2013.01); *C10M 2229/00* (2013.01); *C10N 2020/04* (2013.01); *C10N 2030/04* (2013.01); *C10N 2030/06* (2013.01); *C10N 2030/10* (2013.01); *C10N 2030/42* (2020.05); *C10N 2040/04* (2013.01)

(58) Field of Classification Search

CPC ..... C10M 169/044; C10M 129/76; C10M 133/12; C10M 133/44; C10M 135/30; C10M 137/105; C10M 141/10; C10M 153/04; C10M 155/00; C10M 157/08; C10M 161/00; C10M 2203/003; C10M 2207/284; C10M 2215/26; C10M 2215/30; C10M 2219/087; C10M 2223/047; C10M 2223/049; C10M 2225/00; C10M 2229/00; C10M 155/04; C10M 169/04; C10M 137/04; C10N 2020/04; C10N 2030/04; C10N 2030/06; C10N 2030/10; C10N 2030/42; C10N 2040/04

See application file for complete search history.

(56) References Cited

U.S. PATENT DOCUMENTS 3,081,331 A * 3/1963 Friedman ..... C07F 9/4015 508/423
3,254,025 A 5/1966 Le Suer
(Continued)

FOREIGN PATENT DOCUMENTS

WO WO 2010/126760 A2 11/2010
WO WO 2011/102861 A1 8/2011
WO WO 2016/089565 A1 6/2016

OTHER PUBLICATIONS

International Search Report (PCT/ISA/210), issued in PCT/EP2021/070074, dated Oct. 20, 2021.

*Primary Examiner* — Cephia D Toomer
(74) *Attorney, Agent, or Firm* — Birch, Stewart, Kolasch & Birch, LLP

(57) ABSTRACT

A lubricating composition includes at least one base oil, at least one borated dispersant, at least two antioxidants selected from amine antioxidants, phenolic antioxidants substituted with one or more linear or branched alkyl groups having from 1 to 30 carbon atoms, and mixtures thereof, and at least one phosphite polymer having the formula (I) wherein: —each of the $R^1$, $R^2$, $R^3$ and $R^4$ can be independently selected from the C1-C20 alkyl, C3-C22 alkenyl, C6-C40 cycloalkyl, C7-C40 cycloalkenyl, C1-20 methoxy alkyl glycol ethers and Y—OH groups; —Y is selected from C2-C40 alkylene, C2-C40 alkyl lactone, —$R^7$—N($R^8$)—$R^9$— groups, in which $R^7$, $R^8$ and $R^9$ are independently selected from hydrogen, C1-C20 alkyl, C3-C22 alkenyi, C6-C40 cycloalkyl, C7-C40 cycloalkenyl, C1-20 methoxy alkyl glycol ethers; —m is an integer from 2 to 100; —n is an integer from 1 to 1000.

19 Claims, No Drawings

(51) Int. Cl.

| | |
|---|---|
| ***C10M 141/10*** | (2006.01) |
| ***C10M 153/04*** | (2006.01) |
| ***C10M 155/00*** | (2006.01) |
| ***C10M 157/08*** | (2006.01) |
| ***C10M 161/00*** | (2006.01) |
| *C10N 20/04* | (2006.01) |
| *C10N 30/00* | (2006.01) |
| *C10N 30/04* | (2006.01) |
| *C10N 30/06* | (2006.01) |
| *C10N 30/10* | (2006.01) |
| *C10N 40/04* | (2006.01) |

(56) References Cited

U.S. PATENT DOCUMENTS

| | | | | |
|---|---|---|---|---|
| 3,263,002 | A * | 7/1966 | Friedman | C07F 9/65746 521/169 |
| 2010/0317554 | A1* | 12/2010 | Fuchi | C10M 141/10 508/428 |
| 2015/0291908 | A1* | 10/2015 | Tipton | C10M 153/00 508/442 |

* cited by examiner

LUBRICANT COMPOSITION FOR OXIDATION-STABLE AUTOMOTIVE TRANSMISSION

TECHNICAL FIELD

The present invention relates to the field of lubricant compositions, in particular for automotive vehicles and more especially for lubrication of the transmission components of automotive vehicles, particularly the gearing of the transmissions of internal combustion or electric vehicles.

PRIOR ART

The transmission components of automotive vehicles operate under a heavy load and high speeds. The oils for these transmissions must therefore have particularly good performance to protect parts against wear and fatigue, and in particular to protect the teeth of gearing against the phenomenon of spalling.

Spalling occurs after a long ageing time which precedes visible deterioration. The mechanisms are ill-known, but the phenomenon starts with initiation of cracking at a certain depth below the surface, these cracks propagate and when normal cracking occurs on the surface there is sudden fall-off of parts of material.

The prevention of this phenomenon requires a reduction in contact stresses by means of appropriate geometry of the parts, and a reduction in friction to prevent adhesion. A lubricant composition takes part in this process of prevention chiefly via the physicochemical reactivity of the additives included therein.

In general, the addition is made of sulfur-, phosphorus- or boron-containing antiwear and extreme pressure additives which impart protective properties to transmission oils against spalling. The other additives contained in a lubricant composition can also have a negative or positive impact on the propagation of cracking inside parts, and hence on the phenomenon of spalling.

Throughout its service life, a lubricant composition used in transmission components can start to deteriorate, in particular under the effect of oxidation.

It is therefore one objective of the present invention to provide a lubricant composition for manual or automatic transmissions, in particular for the gearing of transmissions of internal combustion engines or electric motors, having good oxidation stability.

Document WO 2010/126760 describes a lubricant composition comprising a base oil and a polymer of phosphorus ester type comprising the condensation reaction product of an acid or phosphorus ester with a diol in which the two hydroxy functions are separated by a chain of 4 to 100 carbon atoms.

Document WO 2016/089565 describes a lubricant composition comprising a base oil and a phosphite ester composition comprising the condensation reaction product of an acid or phosphorus ester with at least two diols.

These two documents do not disclose the composition of the present invention.

SUMMARY OF THE INVENTION

More specifically, the present invention relates to a lubricant composition comprising:

at least one base oil, at least one boron-containing dispersant, at least two antioxidants selected from among amine antioxidants, phenolic antioxidants substituted by one or more linear or branched alkyl groups having 1 to 30 carbon atoms, and mixtures thereof, and at least one phosphite polymer of formula (I):

[Chem 1]

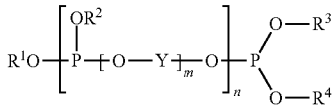

where:

each of $R^1$, $R^2$, $R^3$ and $R^4$ can each independently be selected from among the following groups: $C_1$-$C_{20}$ alkyl, $C_3$-$C_{22}$ alkenyl, $C_6$-$C_{40}$ cycloalkyl, $C_7$-$C_{40}$ cycloalkenyl, $C_1$-$C_{20}$ methoxy alkyl glycol ethers and Y—OH (acting as terminal group);

Y is selected from among the following groups: $C_2$-$C_{40}$ alkylene, $C_2$-$C_{40}$ alkyl lactone, —$R^7$—N($R^8$)—$R^9$— where $R^7$, $R^8$ and $R^9$ are each independently selected from among hydrogen, $C_1$-$C_{20}$ alkyl, $C_3$-$C_{22}$ alkenyl, $C_6$-$C_{40}$ cycloalkyl, $C_7$-$C_{40}$ cycloalkenyl, $C_1$-$C_{20}$ methoxy alkyl glycol ethers, m is an integer ranging from 2 to 100, n is an integer ranging from 1 to 1000.

In one embodiment of the invention, the polymer of formula (I) has a weight average molecular weight lower than 30000 g/mol.

In one embodiment of the invention, the phosphite polymer represents from 0.01 to 10% by weight of the total weight of the lubricant composition.

In one embodiment of the invention, the boron-containing dispersant is selected from among boronated and optionally phosphorated succinimides, preferably boronated polyisobutylene succinimides.

In one embodiment of the invention, the lubricant composition comprises from 5 to 9150 ppm by weight of phosphorus, preferably from 5 to 4500 ppm by weight of phosphorus, relative to the total weight of the lubricant composition.

In one embodiment of the invention, the lubricant composition comprises:

at least one amine antioxidant, and at least one phenolic antioxidant substituted by one or more linear or branched alkyl groups having 1 to 30 carbon atoms.

In one embodiment of the invention, in the lubricant composition:

the amine antioxidant(s) are selected from among diphenylamines, diphenylamines substituted by at least one $C_1$-$C_{30}$ alkyl group, N,N'-dialkyl-aryl-diamines, and/or the phenolic antioxidant(s) substituted by one or more linear or branched $C_1$-$C_{30}$ alkyl groups are selected from among triphenylphosphites in which the phenyl groups are substituted by at least one linear or branched $C_1$-$C_{30}$ alkyl group, phenols substituted by two $C_1$-$C_{30}$ alkyl groups and a $C_1$-$C_{30}$ ester group, the compounds comprising two phenols each substituted by at least one $C_1$-$C_{30}$ alkyl group and linked via a thioether bridge optionally having an ester function on each side of said bridge.

In one embodiment of the invention, the lubricant composition comprises:

70 to 99% by weight of one or more base oils, and 0.01 to 10% by weight of phosphite polymer, 0.01 to 5% by weight of boron-containing dispersant(s), 0.01 to 5% by weight of the mixture of at least one amine antioxidant and at least one phenolic antioxidant substituted by one or more linear or branched $C_1$-$C_{30}$ alkyl groups;

optionally from 1 to 30% by weight of one or more functional additives, preferably selected from among additives improving the viscosity index, antioxidant additives, defoaming additives, boron-free dispersants, detergents, antiwear additives, viscosity modifying additives, and mixtures thereof, relative to the total weight of the lubricant composition.

The invention also concerns the use of a phosphite polymer in combination with a boron-containing dispersant and two antioxidants, to improve the oxidation stability of a lubricant composition comprising at least one base oil, said phosphite polymer replying to formula (I):

[Chem 1]

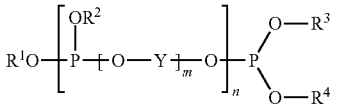

where:

each of R1, R2, R3 and R4 can each be independently selected from among the following groups: $C_1$-$C_{20}$ alkyl, $C_3$-$C_{22}$ alkenyl, $C_6$-$C_{40}$ cycloalkyl, $C_7$-$C_{40}$ cycloalkenyl, $C_1$-$C_{20}$ methoxy alkyl glycol ethers and Y—OH (acting as terminal group);

Y is selected from among the following groups: $C_2$-$C_{40}$ alkylene, $C_2$-$C_{40}$ alkyl lactone, —R7-N(R8)-R9- where R7, R8 and R9 are each independently selected from among hydrogen, $C_1$-$C_{20}$ alkyl, $C_3$-$C_{22}$ alkenyl, $C_6$-$C_{40}$ cycloalkyl, $C_7$-$C_{40}$ cycloalkenyl, $C_1$-$C_{20}$ methoxy alkyl glycol ethers;

m is an integer ranging from 2 to 100, n is an integer ranging from 1 to 1000, the two said antioxidants being selected from among amine antioxidants, phenolic antioxidants substituted by one or more linear or branched alkyl groups having 1 to 30 carbon atoms, and mixtures thereof.

The invention also concerns the use of the lubricant composition of the invention to lubricate at least one mechanical part of an automotive vehicle, preferably contained in a transmission component of an automotive vehicle, and preferably the gearing of an automotive vehicle.

The lubricant composition of the invention has the advantage of exhibiting very good properties to reduce the phenomenon of spalling, in particular when used under a heavy load and under high speeds.

The lubricant composition of the invention typically has good durability.

The lubricant composition of the invention also exhibits good anticorrosion properties.

The lubricant composition of the invention also exhibits very good oxidation stability.

In the remainder hereof, the expressions «between . . . and . . . », «ranging from . . . to . . . » and «varying from . . . to . . . » are equivalent and are intended to indicate that the limits are included, unless otherwise stated.

Unless otherwise stated, the quantities in a product are expressed by weight, relative to the total weight of the product.

DETAILED DESCRIPTION

The present invention concerns a lubricant composition comprising;

at least one base oil, at least one phosphite polymer replying to formula (I), at least one boron-containing dispersant, at least two antioxidants selected from among amine antioxidants, phenolic antioxidants substituted by linear or branched alkyl groups having 1 to 30 carbon atoms, and mixtures thereof.

Phosphite Polymer

The lubricant composition of the invention comprises at least one phosphite polymer replying to formula (I):

[Chem 1]

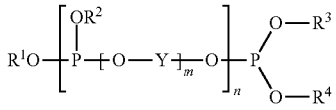

where:

each of $R^1$, $R^2$, $R^3$ and $R^4$ can each be independently selected from among the following groups: $C_1$-$C_{20}$ alkyl, $C_3$-$C_{22}$ alkenyl, $C_6$-$C_{40}$ cycloalkyl, $C_7$-$C_{40}$ cycloalkenyl $C_1$-$C_{20}$ methoxy alkyl glycol ethers and Y—OH (acting as terminal group);

Y is selected from among the following groups: $C_2$-$C_{40}$ alkylene, $C_2$-$C_{40}$ alkyl lactone, —$R^7$—N($R^8$)—$R^9$— where $R^7$, $R^8$ and $R^9$ are each independently selected from among hydrogen, $C_1$-$C_{20}$ alkyl, $C_3$-$C_{22}$ alkenyl, $C_6$-$C_{40}$ cycloalkyl, $C_7$-$C_{40}$ cycloalkenyl, $C_1$-$C_{20}$ methoxy alkyl glycol ethers, m is an integer ranging from 2 to 100, n is an integer ranging from 1 to 1000.

In the meaning of the present invention, by «alkyl» it is meant a linear or branched, non-cyclic saturated hydrocarbon chain optionally comprising one or more heteroatoms such as oxygen, nitrogen or sulfur atoms. Preferably, the alkyls are formed of carbon atoms and hydrogen atoms.

In the meaning of the present invention, by «alkenyl» it is meant a linear or branched, non-cyclic unsaturated hydrocarbon chain optionally comprising one or more heteroatoms such as oxygen, nitrogen or sulfur atoms. Preferably, the alkenyls are formed of carbon atoms and hydrogen atoms.

In the meaning of the present invention, by «cycloalkyl» it is meant a saturated monocyclic or polycyclic group optionally having one or more alkyl or alkenyl substituents, said ring(s) can themselves be substituted by one or more heteroatoms such as oxygen, nitrogen or sulfur atoms. Preferably, the cycloalkyls are formed of carbon atoms and hydrogen atoms.

In the meaning of the present invention, by «cycloalkenyl» it is meant an unsaturated monocyclic or polycyclic group optionally having one or more alkyl or alkenyl substituents, said ring(s) can themselves be substituted by one or more heteroatoms such as oxygen, nitrogen or sulfur atoms. Preferably, the cycloalkenyls are formed of carbon atoms and hydrogen atoms.

In the meaning of the present invention, a «$C_i$-$C_j$ group» is a group having from i to j carbon atoms.

In one preferred embodiment, the Y group is selected from among alkylenes having 2 to 20 carbon atoms, preferably 2 to 12 carbon atoms, more preferably 2 to 8 carbon atoms.

In one embodiment, m ranges from 4 to 100.

In one embodiment the phosphite polymer of formula (I) has a weight average molecular weight lower than 30000 g/mol, preferably ranging from 3000 to 20000 g/mol. Weight average molecular weight can be measured by size exclusion chromatography.

In one embodiment, the phosphite polymer of formula (I) has a number average molecular weight lower than 10000 g/mol, preferably ranging from 1000 to 5000 g/mol. Number average molecular weight can be measured by size exclusion chromatography.

In one embodiment, the phosphite polymer of formula (I) has a polydispersity index ranging from 1 to 5, preferably ranging from 2 to 4.

Preferably, the phosphite polymer of formula (I) contains less than 2% by weight, preferably less than 1% by weight, even less than 0.7% by weight of (alkyl)phenol group, relative to the total weight of the phosphite polymer in formula (I).

Preferably, the phosphite polymer of formula (I) is fully free of aromatic groups differing from the (alkyl)phenol groups.

Typically, the phosphite polymer is in liquid form.

In one embodiment, the phosphite polymer has a phosphorus content ranging from 0.5 to 20% by weight, preferably from 1 to 10% by weight, relative to the total weight of the phosphite polymer.

The phosphite polymer used in the invention can be obtained with the method described in document WO2011102861. In particular, the polymer can be obtained with the method described in paragraphs 27 to 32 of this document.

The synthesis of polymers of formula (I) generally entails a transesterification in which triphenyl phosphite (or any other suitable alkyl or aryl phosphite) can be reacted with a saturated or unsaturated alcohol, or a polyethylene or polypropylene glycol ether, and a diol or a diol polymer $H(OY)_mOH$ where Y and m are such as previously defined, with a suitable basic catalyst at a temperature of between 20° C. and 250° C., and preferably at a temperature of between 50° C. and 185° C. Among nonlimiting examples of saturated or unsaturated alcohols, mention can be made of decyl, isodecyl, lauryl, tridecyl, isotridecyl, tetradecyl, pentadecyl, hexadecyl, stearyl, isostearyl, oleic alcohols, monohydroxylated glycol ethers.

Preferably, the lubricant composition of the invention comprises from 0.01 to 10% by weight of phosphite polymer(s) relative to the total weight of the lubricant composition.

Base Oil(s)

The lubricant composition of the invention comprises one or more base oils, preferably in an amount of at least 70% by weight, preferably ranging from 70 to 99% by weight, more preferably from 80 to 98% by weight, and further preferably from 85 to 95% by weight, relative to the total weight of the lubricant composition.

These base oils can be selected from among base oils conventionally used in the field of lubricant oils, such as mineral, synthetic or natural animal or vegetable oils, or mixtures thereof.

It can be a mixture of several base oils, for example a mixture of two, three or four base oils.

The base oils of the lubricant compositions under consideration in the invention can in particular be oils of mineral or synthetic origin belonging to Groups I to V of the groups defined by the API classification (or the equivalents thereof in the ATIEL classification) and are given in Table 1 below, or mixtures thereof.

TABLE 1

| | Content of saturates | Sulfur content | Viscosity Index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydroisomerized oils | ≥90% | ≤0.03% | ≥120 |
| Group IV | Polyalphaolefins (PAOs) | | |
| Group V | Esters and other bases not included in Groups I to IV | | |

Mineral base oils include all types of base oils obtained by atmospheric or vacuum distillation of crude oil, followed by refining operations such as solvent extraction, deasphalting, solvent dewaxing, hydrotreatment, hydrocracking, hydroisomerization, and hydrofinishing.

Mixtures of synthetic and mineral oils, possibly being biosourced, can also be used.

There is generally no limitation as to the use of different base oils to form the compositions used in the invention, other than the fact that they must have properties in particular in terms of viscosity, viscosity index or oxidation resistance that are adapted for use in the propulsion systems of an electric or hybrid vehicle.

The base oils of the compositions used in the invention can also be selected from among synthetic oils, such as some esters of carboxylic acids and alcohols, polyalphaolefins (PAOs), and polyalkylene glycols (PAGs) obtained by polymerization or copolymerization of alkylene oxides having 2 to 8 carbon atoms, in particular 2 to 4 carbons atoms.

The PAOs used as base oils are obtained for example from monomers having 4 to 32 carbon atoms, for example from octene or decene. The weight average molecular weight of the PAO can vary widely. Preferably, the weight average molecular weight of the PAO is lower than 600 Da. The weight average molecular weight of the PAO can also range from 100 to 600 Da, from 150 to 600 Da, or from 200 to 600 Da.

Advantageously, the base oil or oils of the lubricant composition of the invention can be selected from among the base oils in Group II or Group III.

In one alternative embodiment, the base oil or oils of the composition used in the invention are selected from among polyalphaolefins (PAOs), polyalkylene glycols (PAG) and the esters of carboxylic acids and of alcohols.

Boron-Containing Dispersant

The lubricant composition of the invention comprises one or more boron-containing dispersants.

By «boron-containing dispersant» in the present invention, it is meant a dispersant additive comprising at least one boron atom. Typically, the dispersant will allow the maintained suspension and evacuation of insoluble solid contaminants formed by the secondary products of oxidation which are formed when the lubricant composition is in service.

In one embodiment, the boron-containing dispersant is selected from among boronated succinimide compounds such as boronated polyisobutylene succinimides (PIBSI), or from among boron-phosphorus compounds such as boronated and phosphorated polyisobutylene succinimides (PIBSI).

In one embodiment, the boron compound is selected from among the reaction products of a PIBSA with a boronated polyalkylene amine (PIBSA/boronated PAM), the reaction products of a PIBSA with a boronated and phosphorated polyalkylene amine (PIBSA/boronated-phosphorated PAM).

In one embodiment entailing a dispersant carrying a polyisobutylene chain (PIB), preferably the PIB chain has a molar mass ranging from 750 to 3000 g/mol.

In one embodiment, the boron-containing dispersant has a boron content ranging from 0.1 to 10% by weight, preferably 0.2 to 5% by weight, more preferably 0.25 to 3% by weight, relative to the total weight of the boron-containing dispersant.

In one embodiment, if the boron-containing dispersant is selected from among boron-phosphorous compounds, then the boron content preferably ranges from 0.1 to 10% by weight, preferably from 0.2 to 5% by weight, more preferably from 0.25 to 3% by weight, and the phosphorus content preferably ranges from 0.05 to 5% by weight, preferably 0.1 to 3% by weight, more preferably from 0.2 to 1.5% by weight relative to the total weight of the boron-containing dispersant.

In one particular embodiment, the boron-containing dispersant does not comprise phosphorus.

In one embodiment, the lubricant composition comprises from 0.01 to 5% by weight of boron-containing dispersant(s), preferably from 0.1 to 4% by weight of boron-containing dispersant(s), relative to the total weight of the lubricant composition.

Antioxidants

The lubricant composition of the invention comprises at least two different antioxidants. Said at least two antioxidants are selected from among amine antioxidants, phenolic antioxidants substituted by one or more linear or branched alkyl groups having 1 to 30 carbon atoms, and mixtures thereof.

The antioxidant additive generally allows delaying of degradation of the composition in service. This degradation can particularly translate as the formation of deposits, the presence of sludge or an increase in the viscosity of the composition.

In the meaning of the present invention, a compound is said to be «phenolic substituted by one or more linear or branched alkyl groups having 1 to 30 carbon atoms» when it comprises at least one structure of —O-phenyl type, said phenyl ring being substituted by at least one linear or branched alkyl group having 1 to 30 carbon atoms.

In one embodiment, the phenolic antioxidants substituted by one or more linear or branched $C_1$-$C_{30}$ alkyl groups are selected from among triphenylphosphites in which the phenyl groups are substituted by at least one linear or branched $C_1$-$C_{30}$ alkyl group, phenols substituted by two $C_1$-$C_{30}$ alkyl groups and one $C_1$-$C_{30}$ ester group, compounds comprising two phenols each substituted by at least one $C_1$-$C_{30}$ alkyl group and linked via a thioether bridge optionally having an ester function of each side of said bridge.

Preferably, at least one of the substituents of the phenol groups is selected from among linear or branched $C_1$-$C_{16}$ alkyls, preferably $C_1$-$C_{10}$, more preferably $C_1$-$C_6$. In one embodiment, at least one of the substituents of the phenol groups is a tert-butyl group.

In one embodiment, the amine antioxidants are selected from among aromatic amines of formula $NR^{10}R^{11}R^{12}$ where $R^{10}$ is an optionally substituted aliphatic group or aromatic group, $R^{11}$ is an optionally substituted aromatic group, $R^{12}$ is a hydrogen atom, an alkyl group, an aryl group or a group of formula $R^{13}S(O)_zR^{14}$ where $R^{13}$ is an alkylene group or alkenylene group, $R^{14}$ is an alkyl group, an alkenyl group or aryl group, and z is 0, 1 or 2.

In the meaning of the present invention, an «aromatic» group designates a group comprising at least one aromatic ring. For example, it can be phenyl or naphthyl ring.

In the meaning of the present invention, an «aliphatic» group designates a group which is not aromatic. For example, it can be an alkyl, alkenyl, cycloalkyl or cycloalkenyl group.

In one particular embodiment, the amine antioxidants are selected from among diphenylamines, diphenylamines substituted by at least one $C_1$-$C_{30}$ alkyl group, N,N'-dialkyl-aryl-diamines, preferably from among diphenylamines, diphenylamines substituted by at least one $C_1$-$C_{30}$ alkyl group.

Preferably, the amine antioxidant(s) used in the invention comprise from 1 to 10% by weight of nitrogen, preferably 2 to 7% by weight of nitrogen, relative to the weight of said antioxidant.

In one embodiment of the invention, the lubricant composition comprises at least two antioxidants selected from among triphenylphosphites in which the phenyl groups are substituted by at least one linear or branched $C_1$-$C_{30}$ alkyl group, phenols substituted by two $C_1$-$C_{30}$ alkyl groups and one $C_1$-$C_{30}$ ester group, compounds comprising two phenols each substituted by at least one $C_1$-$C_{30}$ alkyl group and linked via a thioether bridge optionally having an ester function on each side of said bridge, diphenylamines, diphenylamines substituted by at least one $C_1$-$C_{30}$ alkyl group, N,N'-dialkyl-aryl-diamines, and mixtures thereof.

In one embodiment, the lubricant composition comprises:

at least one amine antioxidant, and at least one phenolic antioxidant substituted by one or more linear or branched $C_1$-$C_{30}$ alkyl groups.

Preferably, the lubricant composition comprises:

at least one antioxidant selected from among diphenylamines, diphenylamines substituted by at least one $C_1$-$C_{30}$ alkyl group, N,N'-dialkyl-aryl-diamines, and mixtures thereof, and at least one antioxidant selected from among triphenylphosphites in which the phenyl groups are substituted by at least one linear or branched $C_1$-$C_{30}$ alkyl group, phenols substituted by two $C_1$-$C_{30}$ alkyl groups and one $C_1$-$C_{30}$ ester group, compounds comprising two phenols each substituted by at least one $C_1$-$C_{30}$ alkyl group and linked via a thioether bridge optionally having an ester function on each side of said bridge.

Preferably, the lubricant composition comprises from 0.01 to 5% by weight, even 0.1 to 3% by weight of a mixture of at least two antioxidants selected from among amine antioxidants, phenolic antioxidants substituted by one or more linear or branched alkyl groups having 1 to 30 carbon atoms, and mixtures thereof, relative to the total weight of the lubricant composition.

The inventors have discovered that the combination of a phosphite polymer of formula (I), of a boron-containing dispersant and of two specific antioxidants allows an unexpected improvement to be obtained in the stability against oxidation of the lubricant composition.

Additional Additives

The lubricant composition of the invention may also comprise any types of additional functional additives differing from the phosphite polymer, antioxidant additives and boron-containing dispersant defined in the context of the present invention, and which are adapted for use in a lubricant for automotive vehicles, in particular for manual or automatic transmissions of automotive vehicles.

Such additives, known to persons skilled in the art in the field of lubrication of automotive vehicles, can be selected from among antiwear additives, detergents, boron-free dispersants, antioxidants differing from the antioxidants defined in the present invention, pour point depressants, defoaming agents, viscosity index improvers, and mixtures thereof.

Advantageously, the composition of the invention comprises at least one functional additive selected from among antiwear additives, detergents, boron-free dispersants, antioxidants, pour point depressants, defoaming agents, viscosity index improvers, and mixtures thereof.

Typically, when present, these additional functional additives (together) represent from 1 to 30% by weight, preferably from 1.5 to 25% by weight, more preferably from 2 to 20% by weight of the total weight of the lubricant composition.

These additives can be added alone and/or in the form of a mixture such as those already available for sale in formulations of commercial lubricants for automotive vehicles, having a performance level such as defined by the European Automobile Manufacturers' Association (ACEA) and/or the American Petroleum Institute (API), well known to persons skilled in the art.

The lubricant composition of the invention may optionally comprise one or more antiwear additives. Said antiwear additives can be selected from among phosphorus-antiwear additives, sulfur antiwear additives, sulfur-phosphorus antiwear additives, and mixtures thereof.

In the meaning of the present invention, a «phosphorus antiwear additive» shall designate an antiwear additive comprising at least one phosphorus atom and not comprising sulfur, said phosphorus antiwear additive may optionally comprise one or more nitrogen atoms (in addition to carbon and hydrogen atoms). In this case, it can be designated a «phosphorus-amine antiwear additive».

In the meaning of the present invention, a «sulfur antiwear additive» shall designate an antiwear additive comprising at least one sulfur atom and not comprising phosphorus, said sulfur antiwear additive may optionally comprise one or more nitrogen atoms (in addition to carbon and hydrogen atoms). In this case it can be designated a «sulfur-amine antiwear additive».

In the meaning of the present invention, a «sulfur-phosphorus antiwear additive» shall designate an antiwear additive comprising at least one phosphorus atom and at least one sulfur atom, said sulfur-phosphorus antiwear additive may optionally comprise one or more nitrogen atoms (in addition to carbon and hydrogen atoms). In this case, it can be designated a «sulfur-phosphorus-amine antiwear additive».

Among phosphorus antiwear additives, mention can be made of phosphates, phosphites, and phosphonates. These terms designate phosphoric, phosphorous, phosphonic acids as well as the mono-, di- and triesters thereof, for example alkyl phosphates, alkyl phosphonates, and the salts thereof e.g. amine salts.

The sulfur-phosphorus antiwear additives optionally used in the present invention can be (mono- or di-) thiophosphates and thiophosphites, these terms including thiophosphoric and thiophosphorous acids, the esters of these acids, the salts thereof, dithiophosphites and dithiophosphates.

As examples of sulfur-phosphorus antiwear additives, mention can be made of monobutylthiophosphates, monooctylthiophosphates, monolaurylthiophosphates, dibutylthiophosphates, dilaurylthiophosphates, tributylthiophosphates, trioctylthiophosphates, triphenylthiophosphates, monooctylthiophosphites, trilaurylthiophosphates, monolaurylthiophosphites, monobutylthiophosphites, dibutylthiophosphites, dilaurylthiophosphites, tributylthiophosphites, trioctylthiophosphites, triphenylthiophosphites, trilaurylthiophosphites and the salts thereof.

Examples of the ester salts of thiophosphoric acid and thiophosphorous acid are those obtained by reaction with a nitrogen-containing compound such as ammonia or an amine or zinc oxide or zinc chloride.

In one particular embodiment, the antiwear additive(s) used in the invention are selected from among sulfur-phosphorus antiwear additives, sulfur-amine antiwear additives, and mixtures thereof.

For example, the lubricant composition of the invention may comprise from 0.01 to 5% by weight of antiwear additive(s) relative to the total weight of the lubricant composition.

The quantity of antiwear additives can be adapted to obtain a phosphorus content ranging from 5 to 9150 ppm by weight in the lubricant composition. Preferably, the phosphorus content in the lubricant composition of the invention ranges from 5 to 4500 ppm by weight, relative to the total weight of the lubricant composition.

The lubricant composition of the invention may comprise at least one antioxidant additive differing from the antioxidant additives previously defined in the present invention. Said (different) antioxidant can be selected from among copper compounds for example copper thio- or dithiophosphates, salts of copper and carboxylic acids, dithiocarbamates, sulphonates, phenates, copper acetylacetonates. The salts of copper I and II, the salts of succinic acid or anhydride can also be used.

The lubricant composition of the invention may comprise from 0.5 to 2% by weight of at least one antioxidant additive differing from the antioxidants previously defined in the invention, relative to the total weight of the composition.

The lubricant composition of the invention may also comprise at least one detergent additive.

Detergent additives generally allow a reduction in the forming of deposits on the surface of metal parts, by dissolving the secondary products of oxidation and combustion.

The detergent additives able to be used in the lubricant composition of the invention are generally known to persons skilled in the art. The detergent additives can be anionic compounds comprising a long lipophilic hydrocarbon chain and a hydrophilic head. The associated cation can be a metal cation of an alkali or alkaline-earth metal.

The detergent additives are preferably selected from among the alkali or alkaline-earth metal salts of carboxylic acids, sulfonates, salicylates, naphthenates, and phenate salts. The alkali and alkaline-earth metals are preferably calcium, magnesium, sodium or barium.

These metal salts generally comprise the metal in stoichiometric amount or else in excess, hence in an amount greater than the stoichiometric amount. They are then overbased detergent additives; the excess metal imparting the overbased nature to the detergent additive is then generally in the form of an oil-insoluble metal salt, for example a carbonate, hydroxide, oxalate, acetate, glutamate, preferably a carbonate.

The lubricant composition suitable for the invention may comprise for example from 0.5 to 4% by weight of detergent additive, relative to the total weight of the composition.

Additionally, the lubricant composition of the invention may comprise at least one boron-free dispersing agent.

The boron-free dispersing agent can be selected from among Mannich bases or compounds of succinimide type, such as non-boronated polyisobutylene succinimides (PIBSI).

The lubricant composition of the invention may comprise for example from 0.2 to 10% by weight of boron-free dispersing agent(s), relative to the total weight of the composition.

The lubricant composition of the invention may also comprise at least one defoaming agent.

The defoaming agent can be selected from among silicones.

The lubricant composition of the invention may comprise from 0.01 to 2% by weight, or from 0.01 to 5% by weight, preferably 0.1 to 1.5% by weight, or 0.1 to 2% by weight of defoaming agent, relative to the total weight of the composition.

The lubricant composition of the invention may also comprise at least one pour point depressant additive (PPD).

By slowing the formation of paraffin crystals, pour point depressant additives generally improve the cold properties of the composition. As examples of pour point depressant additives, mention can be made of alkyl polymethacrylates, polyacrylates, polyarylamides, polyalkylphenols, polyalkylnaphthalenes, alkylated polystyrenes.

The lubricant composition of the invention may also comprise at least one additive improving the viscosity index (VI improver). As examples of VI improvers, mention can be made of polymethacrylates, polyisobutenes or fatty acid esters. When present, these additives can represent from 1 to 25% by weight of the total weight of the lubricant composition.

In terms of the formulation of said lubricant composition, the phosphite polymer, the boron-containing dispersant, and optionally the antiwear additive can be added to a base oil or mixture of base oils, followed by the addition of the other optional additional additives.

Alternatively, the phosphite polymer, the boron-containing dispersant and optionally the antiwear additive can be added to a conventional pre-existing lubricant formulation which particularly comprises one or more base oils and optionally additional additives.

Alternatively, the phosphite polymer, the boron-containing dispersant and optionally the antiwear additive defined in the present invention can be combined with one or more additional additives, when included, and the «package» of additives thus formed can be added to a base oil or mixture of base oils.

Advantageously, the lubricant composition of the invention has kinematic viscosity, measured at 40° C. according to standard ASTM D445, which ranges from 5 to 300 $mm^2/s$, in particular from 10 to 25 $mm^2/s$.

Advantageously, the lubricant composition of the invention has kinematic viscosity, measured at 100° C. according to standard ASTM D445, which ranges from 1 to 20 $mm^2/s$, in particular from 2 to 15 $mm^2/s$.

In one particular embodiment, the lubricant composition of the invention comprises, or even is constituted by:

- a base oil or mixture of base oils;
- a phosphite polymer replying to formula (I);
- a boron-containing dispersant selected from among boronated PIBSIs and boronated and phosphorated PIBSIs;
- an amine antioxidant;
- a phenolic antioxidant substituted by one or more linear or branched $C_1$-$C_{30}$ alkyl groups;
- optionally one or more additional additives selected from among antiwear additives, viscosity index modifiers, detergents, boron-free dispersants, antioxidants, pour point depressants, defoaming agents, and mixtures thereof.

In one particular embodiment, the lubricant composition of the invention comprises, or even is constituted by:

- at least 70% by weight, preferably 70 to 99% by weight of base oils;
- from 0.05% to 10% by weight, in particular 0.10% to 7% by weight, and more particularly 1% to 5% by weight of phosphite polymer(s) replying to formula (I);
- from 0.01 to 5% by weight of boron-containing dispersant(s) selected from among boronated PIBSIs and boronated-phosphorated PIBSIs;
- from 0.01 to 5% by weight of the mixture of at least one amine antioxidant and at least one phenolic antioxidant substituted by one or more linear or branched $C_1$-$C_{30}$ alkyl groups;
- optionally from 1 to 20% by weight, preferably 1.5 to 10% by weight, more preferably 2 to 5% by weight of one or more functional additives preferably selected from among antiwear additives, viscosity index modifiers, detergents, boron-free dispersants, antioxidants, pour point depressants, defoaming agents, and mixtures thereof.

In one embodiment, the lubricant composition of the invention comprises from 5 to 4000 ppm by weight of sulfur, preferably from 7 to 1000 ppm by weight of sulfur, more preferably 10 to 800 ppm by weight of sulfur, relative to the total weight of the lubricant composition.

In one embodiment, the lubricant composition of the invention comprises from 5 to 9150 ppm by weight of phosphorus, preferably from 5 to 4500 ppm by weight of phosphorus, relative to the total weight of the lubricant composition.

In one embodiment, the boron content of the lubricant composition ranges from 5 to 500 ppm, preferably from 10 to 300 ppm by weight, relative to the total weight of the lubricant composition.

In one embodiment, the nitrogen content of the lubricant composition ranges from 5 to 5000 ppm, preferably from 10 to 2000 ppm by weight, relative to the total weight of the lubricant composition.

The present invention also concerns the use of the phosphite polymer such as previously defined in combination with a boron-containing dispersant and two antioxidants such as defined in the present invention, in a lubricant composition comprising at least one base oil, to improve the oxidation stability of said lubricant composition.

Preferably, the use of the invention is characterized by a change in viscosity at 100° C. of the lubricant composition comprising at least one base oil, said phosphite polymer, said boron-containing dispersant and said antioxidants, that is less than 10% according to the DIN 51659-2 method.

A further subject of the present invention is the use of the lubricant composition of the invention to lubricate the transmissions of automotive vehicles, in particular the gear of transmissions. The transmissions can be manual or automatic transmissions.

Preferably, the lubricant composition of the invention is used to reduce the wear of a mechanical part of a transmission of automotive vehicles, in particular the gear of automotive vehicles. Therefore, in this embodiment, the lubricant composition of the invention allows the wear of transmission gear to be reduced.

Preferably, the lubricant composition of the invention is used to reduce spalling of a mechanical part of the transmission of an automotive vehicle, in particular spalling of a gearing in automotive vehicles.

In one advantageous embodiment, the lubricant composition of the invention is used both to reduce wear and to reduce the spalling of a mechanical part of the transmission of automotive vehicles, in particular a gear of automotive vehicles.

In another aspect, the invention further concerns a method for lubricating at least one part of a transmission of an automotive vehicle, in particular a gear of an automotive vehicle, which comprises at least one step of contacting at least said part with a lubricant composition such as previously described.

In another aspect, the invention further concerns a method for improving the oxidation stability of a lubricant composition, said method comprising a step of mixing at least one phosphite polymer of formula (I) such as defined in the present invention, at least one boron-containing dispersant and at least two antioxidants such as defined in the present invention, with at least one base oil, preferably said polymer, said dispersant and said oxidants are also mixed with an antiwear additive.

All the characteristics and preferences described for the lubricant composition of the invention and for the uses thereof, also apply to these methods.

In the invention, the particular advantageous or preferred characteristics of the composition of the invention allow the defining of the uses of the invention which are also particular, advantageous or preferred.

The invention is now described by means of the following examples evidently given for illustration purposes and not limiting the invention.

EXAMPLES

Example 1: Preparation of the Lubricant Compositions

The lubricant compositions were prepared by mixing the ingredients at a temperature of about 40° C., following methods well known to those skilled in the art. The prepared and tested lubricant compositions are detailed in Table 2 below. The percentages are weight percentages relative to the total weight of the lubricant composition.

The elemental content of phosphorus, boron, sulfur and amine was calculated as a function of the elemental composition of the ingredients, and is also given in Table 2 in ppm by weight.

Finally, the kinematic viscosities at 40° C. and at 100° C. were determined with the ASTM D445 method and are given in Table 2.

TABLE 2

| | CC1 | CC2 | CI1 | CI2 | CI3 |
|---|---|---|---|---|---|
| Base oils (%) | 96.275 | 96.575 | 97.1 | 94.6 | 94.25 |
| Phosphite polymer (%) | 1.0 | 1.0 | 0.5 | 0.5 | 0.5 |
| Sulfur-phosphorus antiwear (%) | 0.025 | 0.025 | 0.1 | 0.1 | 0.1 |
| Boron-containing dispersant (%) | | | | 3.0 | 3.0 |
| Born-free dispersant (%) | 1.0 | 1.0 | | | |
| Boron-phosphorus dispersant (%) | | | 1.0 | | |
| Amine antioxidant 1 (%) | 1.0 | 0.35 | 0.5 | 0.5 | 0.9 |
| Amine antioxidant 2 (%) | | 0.35 | | | |
| Phenolic antioxidant 1 (%) | | | | | 0.5 |
| Phenolic antioxidant 2 (%) | | | 0.4 | 0.4 | |
| Phenolic antioxidant 3 (%) | | | 0.15 | 0.15 | |
| Anti-corrosion (%) | 0.05 | 0.05 | 0.1 | 0.1 | 0.1 |
| Detergent (%) | 0.1 | 0.1 | 0.1 | 0.1 | 0.1 |
| Additive package (%) | 0.55 | 0.55 | 0.55 | 0.55 | 0.55 |
| Total (wt. %) | 100 | 100 | 100 | 100 | 100 |
| P content (ppm) | 473 | 716 | 468 | 393 | 318 |
| B content (ppm) | 0 | 0 | 100 | 120 | 120 |
| S content (ppm) | 65 | 65 | 409 | 409 | 213 |
| N content (ppm) | 845 | 553 | 548 | 750 | 930 |
| KV40 ($mm^2/s$) - ASTM D445 | 20.01 | 20.22 | 20.12 | 21.3 | 21.11 |
| KV100 ($mm^2/s$) - ASTM D445 | 4.407 | 4.432 | 4.425 | 4.609 | 4.578 |

In the compositions in Table 2:

the base oils are Group III base oils, the phosphite polymer replies to formula (I) and comprises 4.50% by weight of phosphorus and zero sulfur, it has a weight average molecular weight of about 10000 g/mol and a number average molecular weight of about 3000 g/mol; it can be obtained for example following the method described in Example 2 of document WO 2011/102861, the sulfur-phosphorus antiwear additive is of phosphorothionate type and comprises 9.30% by weight of phosphorus and 19.80% by weight of sulfur, the boron-containing dispersant is a boronated PIBSI comprising 0.40% by weight of boron and zero phosphorus, the boron-free dispersant is an amine dispersant comprising 3.20% by weight of nitrogen and zero boron and zero phosphorus, the boron phosphorus dispersant is a boronated phosphorated PIBSI comprising 1% by weight of boron and 0.75% by weight of phosphorus, the amine antioxidant 1 is an alkylated diphenylamine antioxidant comprising 4.50% by weight of nitrogen, the amine antioxidant 2 is a naphthyl-phenyl-alkylamine antioxidant comprising 4.78% by weight of nitrogen, the phenolic antioxidant 1 is an antioxidant comprising a phenol group substituted by two $C_1$-$C_{30}$ alkyl groups and a $C_1$-$C_{30}$ ester group, this phenolic antioxidant 1 comprises neither sulfur, nor phosphorus nor nitrogen, the phenolic antioxidant 2 is an antioxidant comprising two phenol groups each substituted by at least one $C_1$-$C_{30}$ alkyl group and linked via a thioether bridge having an ester function on each side of said bridge, this phenolic antioxidant 2 comprises 4.90% by weight of sulfur, and zero nitrogen and zero phosphorus, the phenolic antioxidant 3 is a triphenylphosphite antioxidant in which the 3 phenyl groups are substituted by at least one linear or branched $C_1$-$C_{30}$ alkyl group, this phenolic antioxidant 3 comprises 5% by weight of phosphorus, and zero nitrogen and zero sulfur, the anti-corrosion additive is a tolytriazine, the detergent is an overbased, calcium sulfonate detergent, the additive package contains a pour point depressant and a defoamer.

Example 2: Studies on the Performance of the Lubricant Compositions

Oxidation stability was assessed by measuring the change in viscosity at 100° C. for a test time of 192 h at 170° C., according to standard DIN 51659-2. The change in viscosity is expressed as % in Table 3 below.

TABLE 3

| | CC1 | CI1 | CI2 | CI3 |
|---|---|---|---|---|
| Change in viscosity (%) | 37.9 | 11.87 | −0.13 | 0.74 |

The results in Table 3 show that the viscosity does not vary substantially over a long period time, during this test at 170° C., which demonstrates the very good oxidation stability of the lubricant compositions of the invention. In particular, the compositions of the invention show better stability against oxidation than the comparative composition CC1.

Example 3: Studies on the Performance of the Lubricant Compositions

In this example, oxidation stability was assessed by measuring the change in viscosity at 100° C. for a test time of 384 h at 170° C., according to standard DIN 51659-2. The change in viscosity is expressed as % in Table 4 below.

TABLE 4

| | CC1 | CC2 | CI1 |
|---|---|---|---|
| Change in viscosity (%) | 37.9 | 81.9 | 15.74 |

The results in Table 4 show that the viscosity does not vary substantially over a very long period of time, during this test at 170° C., which demonstrates the very good oxidation stability of the lubricant compositions of the invention. In particular, the composition of the invention has better stability against oxidation than the comparative compositions CC1 and CC2.

The invention claimed is:

1. A lubricant composition comprising:

70 to 99% by weight of at least one base oil;

0.01 to 5% by weight of at least one boron-containing dispersant;

0.01 to 5% by weight of at least two antioxidants selected from among amine antioxidants, phenolic antioxidants substituted by one or more linear or branched alkyl groups having 1 to 30 carbon atoms, and mixtures thereof; and 0.01 to 10% by weight of at least one phosphite polymer of formula (I):

[Chem 1]

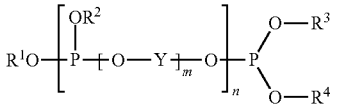

where:

each of $R^1$, $R^2$, $R^3$ and $R^4$ can each be independently selected from among the following groups: $C_1$-$C_{20}$ alkyl, $C_3$-$C_{22}$ alkenyl, $C_6$-$C_{40}$ cycloalkyl, $C_7$-$C_{40}$ cycloalkenyl, $C_{1-20}$ methoxy alkyl glycol ethers and Y—OH;

Y is selected from among the following groups: $C_2$-$C_{40}$ alkylene, $C_2$-$C_{40}$ alkyl lactone, —$R^7$—N($R^8$)—$R^9$— where $R^7$, $R^8$ and $R^9$ are each independently selected from among hydrogen, $C_1$-$C_{20}$ alkyl, $C_3$-$C_{22}$ alkenyl, $C_6$-$C_{40}$ cycloalkyl, $C_7$-$C_{40}$ cycloalkenyl, $C_{1-20}$ methoxy alkyl glycol ethers;

m is an integer ranging from 2 to 100; and n is an integer ranging from 1 to 1000.

2. The lubricant composition according to claim 1, wherein the polymer of formula (I) has a weight average molecular weight lower than 30000 g/mol.

3. The lubricant composition according to claim 1, wherein the phosphite polymer represents from 0.01 to 10% by weight of the total weight of the lubricant composition.

4. The lubricant composition according to claim 1, wherein the boron-containing dispersant is selected from among boronated and optionally phosphorated succinimides.

5. The lubricant composition according to claim 1, comprising from 5 to 9150 ppm by weight of phosphorus, relative to the total weight of the lubricant composition.

6. The lubricant composition according to claim 1, comprising:

at least one amine antioxidant, and at least one phenolic antioxidant substituted by one or more linear or branched alkyl groups having 1 to 30 carbon atoms.

7. The lubricant composition according to claim 1, wherein:

the amine antioxidant(s) are selected from among diphenylamines, diphenylamines substituted by at least one $C_1$-$C_{30}$ alkyl group, N,N'-dialkyl-aryl-diamines, and/or the phenolic antioxidant(s) substituted by one or more linear or branched $C_1$-$C_{30}$ alkyl groups are selected from among triphenylphosphites in which the phenyl groups are substituted by at least one linear or branched $C_1$-$C_{30}$ alkyl group, phenols substituted by two $C_1$-$C_{30}$ alkyl groups and one $C_1$-$C_{30}$ ester group, compounds comprising two phenols each substituted by at least one $C_1$-$C_{30}$ alkyl group and linked via a thioether bridge optionally having an ester function on each side of said bridge.

8. The lubricant composition according to claim 1, comprising:

70 to 99% by weight of one or more base oils;

0.01 to 10% by weight of phosphite polymer;

0.01 to 5% by weight of boron-containing dispersant(s);

0.01 to 5% by weight of the mixture of at least one amine antioxidant and at least one phenolic antioxidant substituted by one or more linear or branched $C_1$-$C_{30}$ alkyl groups; and 1 to 30% by weight of one or more functional additives, relative to the total weight of the lubricant composition.

9. A method for improving the oxidation stability of a lubricant composition comprising at least one base oil, the method comprising adding a phosphite polymer in combination with a boron-containing dispersant and two antioxidants into the lubricant composition, said phosphite polymer replying to formula (I):

[Chem 1]

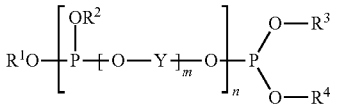

where:

each of $R^1$, $R^2$, $R^3$ and $R^4$ can each be independently selected from among the following groups: $C_1$-$C_{20}$ alkyl, $C_3$-$C_{22}$ alkenyl, $C_6$-$C_{40}$ cycloalkyl, $C_7$-$C_{40}$ cycloalkenyl, $C_{1-20}$ methoxy alkyl glycol ethers and Y—OH (acting as terminal group);

Y is selected from among the following groups: $C_2$-$C_{40}$ alkylene, $C_2$-$C_{40}$ alkyl lactone, —$R^7$—N($R^8$)—$R^9$— where $R^7$, $R^8$ and $R^9$ are each independently selected from among hydrogen, $C_1$-$C_{20}$ alkyl, $C_3$-$C_{22}$ alkenyl, $C_6$-$C_{40}$ cycloalkyl, $C_7$-$C_{40}$ cycloalkenyl, $C_{1-20}$ methoxy alkyl glycol ethers;

m is an integer ranging from 2 to 100; and n is an integer ranging from 1 to 1000, said two antioxidants being selected from among amine antioxidants, phenolic antioxidants substituted by one or more linear or branched alkyl groups having 1 to 30 carbon atoms, and mixtures thereof, wherein the lubricant composition comprises 70 to 99% by weight of one or more base oils, 0.01 to 10% by weight of phosphite polymer, 0.01 to 5% by weight of boron-containing dispersant(s), 0.01 to 5% by weight of the mixture of at least one amine antioxidant and at least one phenolic antioxidant substituted by one or more linear or branched $C_1$-$C_{30}$ alkyl groups, relative to the total weight of the lubricant composition.

10. A method for lubricating at least one mechanical part of an automotive vehicle, the method comprising contacting the composition according to claim 1 with the at least one mechanical part.

11. The lubricant composition according to claim 1, wherein the polymer of formula (I) has a weight average molecular weight ranging from 3000 to 20000 g/mol.

12. The lubricant composition according to claim 1, wherein the dispersant is selected from among boronated polyisobutylene succinimides.

13. The lubricant composition according to claim 1, comprising from 5 to 4500 ppm by weight of phosphorus, relative to the total weight of the lubricant composition.

14. The lubricant composition according to claim 1, comprising from 5 to 4000 ppm by weight of sulfur, relative to the total weight of the lubricant composition.

15. The lubricant composition according to claim 1, further comprising at least one antiwear additive selected from among selected from among phosphorus-antiwear additives, sulfur antiwear additives, sulfur-phosphorus antiwear additives, and mixtures thereof.

16. The lubricant composition according to claim 15, comprising from 0.01 to 5% by weight of the at least one antiwear additive, relative to the total weight of the lubricant composition.

17. The lubricant composition according to claim 8, wherein the functional additives are selected from among viscosity index improver additives, antioxidant additives, defoaming additives, boron-free dispersants, detergents, antiwear additives, viscosity modifier additives, and mixtures thereof.

18. The method according to claim 10, wherein the mechanical part of an automotive vehicle is contained in a transmission component of an automotive vehicle.

19. The method according to claim 18, wherein the mechanical part of an automotive vehicle is contained in a transmission component of an automotive vehicle is a gear of an automotive vehicle.

* * * * *